United States Patent [19]

Krukoski

[11] Patent Number: 4,864,813

[45] Date of Patent: Sep. 12, 1989

[54] CONTROL SYSTEM FOR A GAS TURBINE ENGINE

[75] Inventor: Leon Krukoski, Coventry, Conn.

[73] Assignee: United Technologies Corporation, Hartford, Conn.

[21] Appl. No.: 197,715

[22] Filed: May 23, 1988

Related U.S. Application Data

[62] Division of Ser. No. 70,997, Jul. 8, 1987.

[51] Int. Cl.[4] ..... F02C 9/18

[52] U.S. Cl. ..... 60/39.29; 364/431.02

[58] Field of Search ..... 60/39.02, 39.03, 39.27, 60/39.29; 415/1, 27, 28; 364/431.02

[56] References Cited

U.S. PATENT DOCUMENTS

| | | | |
|---|---|---|---|
| 4,502,275 | 3/1985 | Petro | 60/39.29 |
| 4,603,546 | 8/1986 | Collins | 60/39.29 |
| 4,622,808 | 11/1986 | Kenison et al. | 60/39.29 |
| 4.697,980 | 10/1987 | Keyes et al. | 415/1 |
| 4,702,070 | 10/1987 | Cureton et al. | 60/39.29 |

*Primary Examiner*—Louis J. Casaregola

*Attorney, Agent, or Firm*—Edward L. Kochey, Jr.

[57] ABSTRACT

When a stall is dectected during high power operation, the engine is given one chance to recover without a change in bleed schedule. Should a record stall occur within 10 seconds the control system switches to an override bleed schedule for 5½ minutes, or until throttle is reduced. This supplies a minimum adaquate thrust for a limited time.

6 Claims, 2 Drawing Sheets

CONTROL SYSTEM FOR A GAS TURBINE ENGINE

This is a division of application Ser. No. 070,997 filed on July 8, 1987 pending.

TECHNICAL FIELD

The invention relates to gas turbine engines for aircraft and in particular to a control system for handling foreign object damage of such engines.

The basic purpose of a gas turbine control system in an aircraft is to regulate operation of the engine to obtain thrust desired by the pilot along with efficiency, safety and engine component life. Such engines include bleed valves to selectively draw off air from the compressor. The normal operating bleed schedule opens these valves at certain operating conditions to provide a satisfactory margin from stall.

A stall may occur for various reasons such as too rapid acceleration or deceleration, ingestion of hot gas from a preceeding plane, and others which also lead to a temporary stall condition. In many cases the engine will self recover and in others will recover upon reduction of throttle. It is known from U.S. Pat. No. 4,603,546 to operate on a modified bleed schedule in response to a stall, until later ground maintenance.

Foreign object damage to an engine may occur, for instance, by ingestion of birds. Because of the nature of the cause of such damage, it is probable that this will simultaneously occur to more than one engine. Such foreign object damage may damage the engine such that it cannot operate on its normal bleed schedule without repeated stalling. It is possible to operate such a damaged engine on a modified bleed air schedule with more bleed air. This, however, will reduce efficiency and raise component temperatures within the engine. Under certain conditions such as takeoff, this sacrifice can readily be made to obtain satisfactory continued thrust.

DISCLOSURE OF THE INVENTION

Whenever a stall is detected during a high power condition such as takeoff, the control system gives the engine one chance to recover from a stall. If a second high power stall occurs within 10 seconds of the recovery from the first, it is assumed that foreign object damage has occurred.

The control system switches to an override bleed schedule to keep the engines operating at a required thrust level for a limited period of time. This limited period of time is selected to be sufficiently long to permit completion of the high power operation such as a takeoff. After this limited period of time the engine is released to the normal bleed schedule at which time the pilot may take whatever steps he deems appropriate.

Accordingly, whenever the bleed valves are fully closed, the system monitors for a stall and a subsequent recovery. If a second stall does not occur within 10 seconds of the recovery, no action is taken. If a second stall does occur within 10 seconds, and if it occurs with the bleed valves less than 25 percent open, it is likely that foreign object damage has occurred. The engine then operates on the override bleed schedule for 5½ minutes or until throttle is reduced, whichever occurs first. Thereafter the control system is returned to the normal bleed air schedule.

The override bleed schedule is selected to provide adequate takeoff thrust and the selected 5½ minutes is sufficient to safely complete the takeoff operation, but not so long as to produce excessive damage to the engine.

BEST MODE FOR CARRYING OUT THE INVENTION

Figure 1:
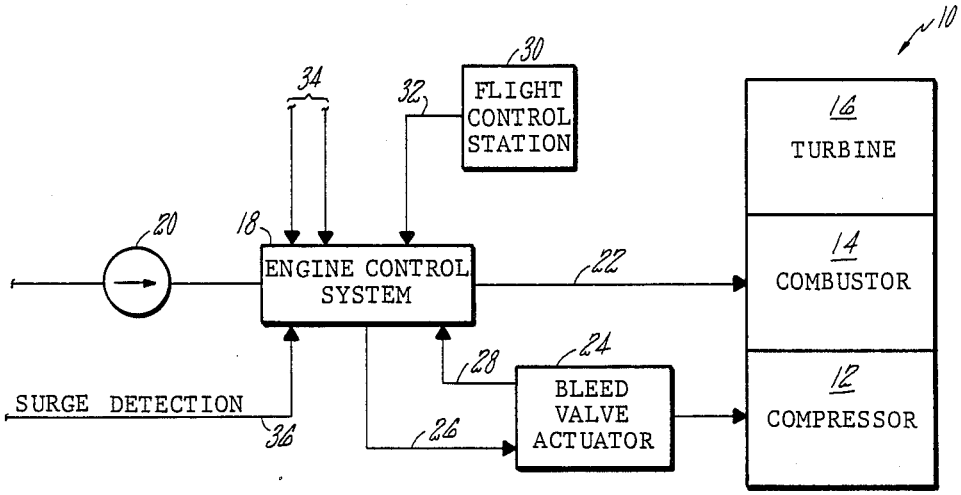
FIG. 1 is a simplified general control schematic of the control system.

Gas turbine 10 includes compressor 12, a combustor 14 and a turbine 16. Engine control system 18 regulates amongst other things high pressure fuel from fuel pump 20 passing through fuel line 22 to combustor 14. A bleed valve actuator unit 24 operates bleed valves in the compressor and also senses the position of the valves. Control signals through line 26 from the engine control system to the bleed valve actuator unit dictate the desired position of the valves while signal passing through line 28 back to the engine control system indicates the position of the valves. From the flight control station 30 a control signal 32 is passed to the engine control system with this signal indicating the desired thrust. Various other parameters 34 enter the engine control system along with a control signal 36 that is used for surge detection.

Figure 2:
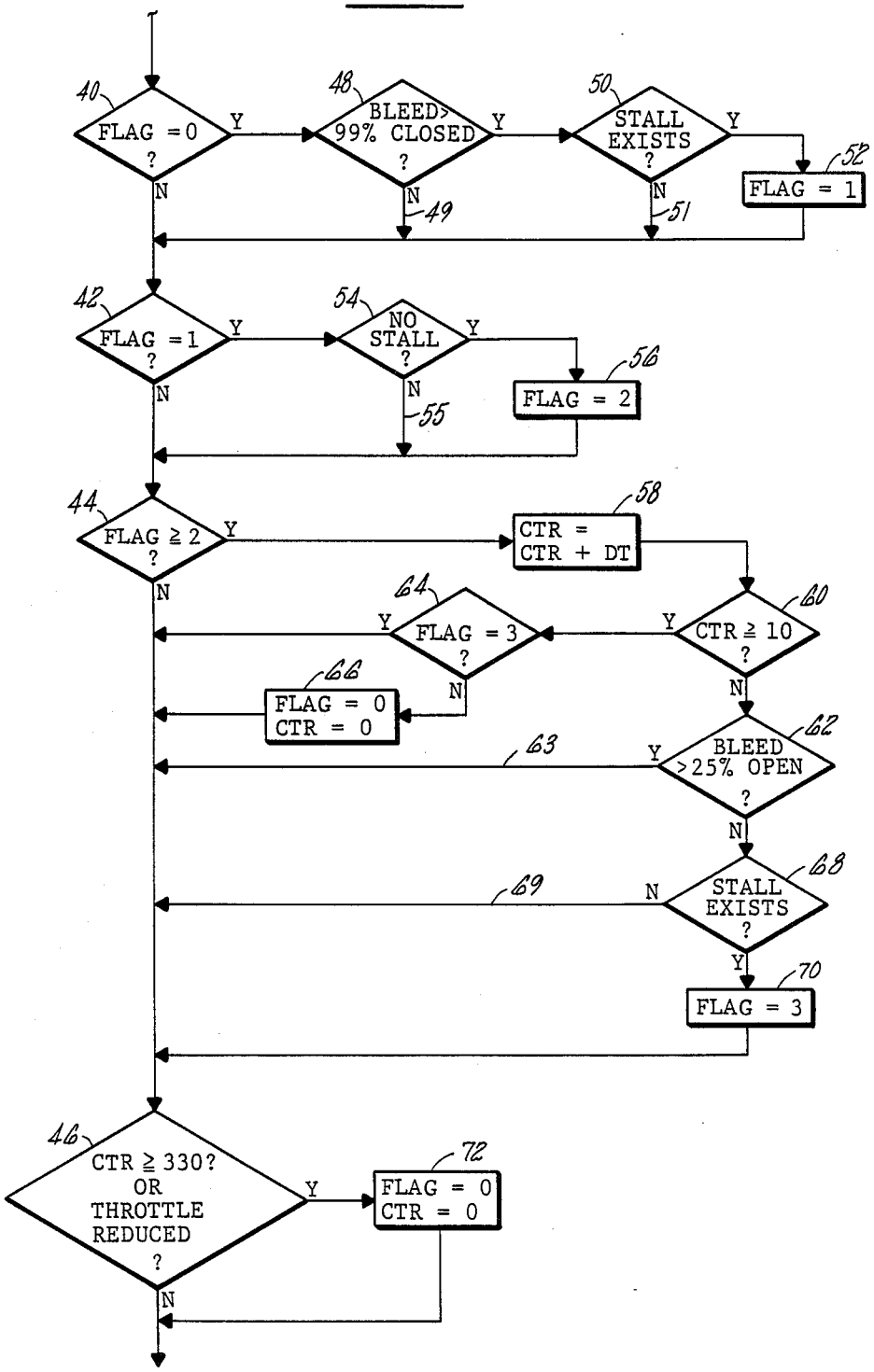
FIG. 2 is a logic diagram of the invention.

Referring to the logic diagram of FIG. 2 the concept of a flag is used although other equivalent methods of implementing the system could be used. In the main logic loop instruction 40 looks for flag equal to zero, instruction 42 looks for the flag equal to 1, instruction 44 looks for the flag equal to or greater than 2. Instruction 46 looks for parameters which will be discussed later with the logic then returning to flag 40.

With flag zero being the starting point, instruction 40 determining the flag reset to the zero position interrogates instruction 48 to determine whether the bleed valves are greater than 99 percent closed. If they are not, the logic reverts through line 49 to the main loop. This renders the system inoperative at low power conditions when the protection is not required.

If the bleeds are greater than 99 percent closed, instruction 50 is interrogated to determine whether a stall exists. Should no stall exist, the logic passes through 51 returning to the main loop. If, however, a stall does exist, action 52 sets the flag equal to one.

Instruction 42 determining that the flag is equal to one interrogates instruction 54 looking for a recovery from the stall. If the stall has not recovered, the logic passes through 55 returning to the main loop. With the flag remaining equal to one, instruction 42 continuously interrogates instruction 54. Should a recovery from the stall be detected, action 56 sets the flag equal to 2.

With the flag equal to 2 the logic passes to action 58 which starts a counter and a logic passes to instruction 60 to determine whether 10 seconds have yet expired on the counter. If the time has not expired, instruction 62 is interrogated to determine whether the bleed valves are greater than 25 percent open. This essentially renders the system inoperative with significantly open bleed valves because it indicates either the engne has not had enough time to reaccelerate back to the original power setting, or the power request has been reduced to some intermediate level.

If the bleeds are greater than 25 percent open the signal 63 returns to the main loop. Should this situation continue for more than 10 seconds, the logic from instruction 60 interrogates instruction 64. Since the flag still remains at 2 the logic passes to action 66 which resets both the flag and the counter.

With the flag at 2 for less than 10 seconds in accordance with the instruction 60 and a bleed less than 25 percent open in accordance with instruction 62, instruction 68 is interrogated to determine whether a second stall has occurred. If a second stall has not occurred, the logic returns 69 to the main loop continuing the cycle until the 10 seconds has expired in which case the flag and counter are both reset. This then detects the absence of a second stall within 10 seconds of the recovery of the first and returns the system to its original condition.

If, however, within this 10 seconds a stall is detected in accordance with instruction 68, action 70 sets the flag equal to 3. Therefore, after the ten seconds expires, instruction 64 detecting a flag equal to 3 does not reset the flag but continues the logic through instruction 46. Instruction 46 is interrogated to determine whether the timer or counter has reached 330 seconds or 5½ minutes or whether the pilot has reduced the throttle. So long as neither of these have occurred, the system continues operation with the flag set at 3. Should, however, the 5½ minutes expire or should the throttle be reduced, then action 72 resets both the flag and the counter.

Figure 3:
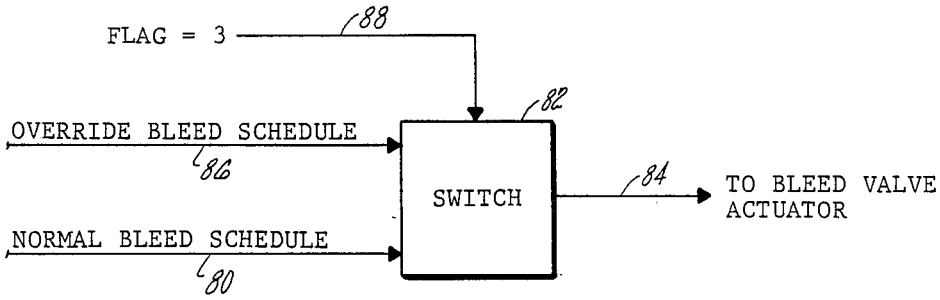
FIG. 3 is a portion of the control diagram showing the override feature.

When the flag equals 3, in addition to effecting the logic diagram it also modifies the control system. Referring to FIG. 3 the normal bleed schedule 80 passes through switch 82 and control line 84 to the bleed actuator unit. An override bleed schedule 86 is also provided. This override bleed schedule is selected to provide the required thrust from the gas turbine engine to complete critical operations such as takeoff, with sufficient margin from stall conditions to accept operation with an engine damaged by foreign objects. When the flag is set to 3 in accordance with the logic diagram, a flag equals 3 signal 88 is transmitted to switch 82, thereby switching the control signal from the normal bleed schedule to the override bleed schedule 86.

In accordance with the control system when an engine stalls under high power conditions and recovers, it is monitored for 10 seconds to determine whether a second stall occurs. If so, corrective action is taken to maintain adequate thrust throughout a takeoff with the engine thereafter being released to normal conditions. If a second stall does not occur within 10 seconds of the recovery, the engine continues its normal operation. When foreign object damage situation occurs it is quite likely that all engines could be damaged and accordingly is extremely critical that sufficient thrust be maintained on the engines to properly execute the high power maneuver being undertaken.

I claim:

1. A foreign object damage control system for an aircraft gas turbine engine comprising:

stall detector means;

bleed valve postion detecting means;

first setting means for setting a first flag in response to a detected stall;

a second setting means for setting a second flag in response to a detected recovery from stall, but only in the presence of said first flag;

a timer;

means for starting said timer in response to the setting of said second flag;

third setting means for setting a third flag in response to a detected stall during a preselected first time period of the time cycle of said timer;

reset means for resetting said third flag in response to a detected stall not occurring during the first period of the time cycle of said timer;

a normal bleed schedule;

an override bleed schedule; and means for replacing said normal bleed schedule with said override bleed schedule in response to the setting of said third flag.

2. An apparatus as in claim 1 having also:

means for returning to said normal bleed schedule in response to the expiration of a pre-established second time period of the time cycle of said timer.

3. An apparatus as in claim 1 having also:

means for blocking said first setting means in response to the detection of said bleed valves being not substantially open.

4. An apparatus as in claim 1 having also:

means for blocking said third setting means in response to the detection of said bleed valves being greater than 25 percent open.

5. An apparatus as in claim 1 having also:

means for detecting throttle position; and means for returning to said normal bleed schedule in response to detection of a low throttle position.

6. An apparatus as in claim 1 having also:

means for blocking said first setting means in response to the detection of said bleed valves being not substantially open;

means for blocking said third setting means in response to the detection of said bleed valves being greater than 25 percent open;

means for detecting throttle position; and means for returning to said normal bleed schedule in response to detection of a low throttle position.

* * * * *